United States Patent [19]

Lin

[11] Patent Number: 4,568,269

[45] Date of Patent: Feb. 4, 1986

[54] MUSICAL CANDLE

[76] Inventor: Tung Lin, No. 382, Sung Chiang Rd., Taipei, Taiwan

[21] Appl. No.: 681,986

[22] Filed: Dec. 14, 1984

[51] Int. Cl.[4] ..... F23D 3/02

[52] U.S. Cl. ..... 431/253; 431/289; 84/2; 84/171

[58] Field of Search ..... 431/253, 289, 288; 84/2, 170, 171

[56] References Cited

U.S. PATENT DOCUMENTS 2,627,174 2/1953 Weglin ..... 431/288 X 4,477,249 10/1984 Ruzek et al. ..... 431/253

FOREIGN PATENT DOCUMENTS 2228834 12/1974 France ..... 431/289

*Primary Examiner*—Randall L. Green

*Attorney, Agent, or Firm*—Townsend and Townsend

[57] ABSTRACT

A musical candle, having a candle provided with a pair of electric conductors along the candle, and a musical device to which the pair of electric conductors is connected. When the candle is lit, the pair of electric conductors is burned to melt and fuse together to form a closed electric connection thus activating the musical device to produce a musical sound.

5 Claims, 5 Drawing Figures

MUSICAL CANDLE

BACKGROUND OF THE INVENTION

This invention relates to a musical candle which, when lit, will produce a musical sound.

At marriage parties and other gatherings, particularly birthday parties, candles and music are used to create a special mood and atmosphere to fit the occasion. Conventional candles are available in a number of shapes, colors and sizes but do not produce sounds particularly musical sounds. Separate sound production equipment is always required if one wishes to have, in addition to candles, music at a party. Therefore this invention offers a musical candle which produces a musical sound after the candle has been lit, so as to enhance the fun at the occasions.

SUMMARY OF THE INVENTION

This invention offers a musical candle having a candle with a pair of conductors disposed along the length of the candle, the pair of conductors forming a part of the electric circuit of a musical device. When the candle is lit, or burns to a predetermined length, the end of the pair of conductors is fused together and electrically connected, thus electrically closing and energizing the electric circuit of the musical device to produce a musical sound.

DETAILED DESCRIPTION OF THE INVENTION

Figure 1:
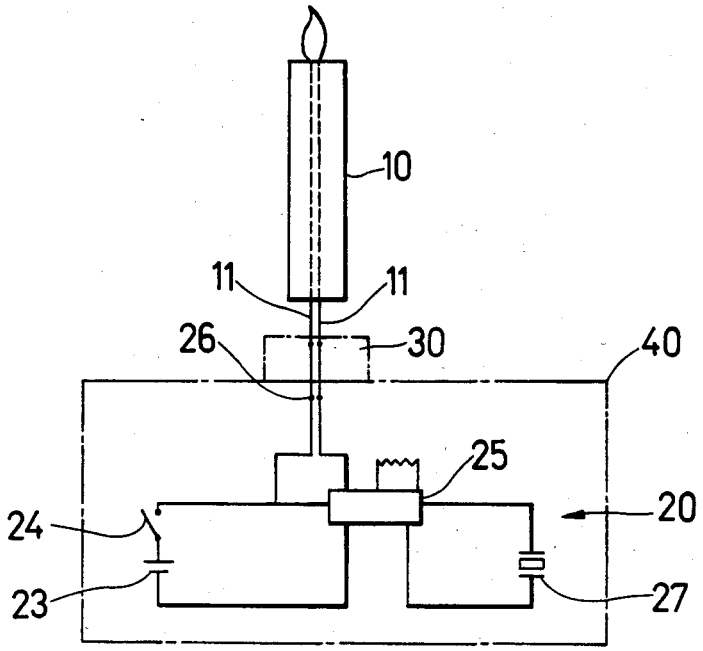
FIG. 1 is a schematic, electrical circuit diagram of an embodiment of the musical candle of this invention.

As shown in FIG. 1, the musical candle of this invention comprises a candle 10 having a pair of electric conductors 11, 11, such as insulated copper or aluminum wire; that can be burned by candle flame to fuse together, and a musical device 20 including a musical integrated circuit 25 ( hereafter as musical IC ), which may be a Melody IC ERSO 3830 SER. or equivalent, a battery 23 and a switch 24 connected to form an electric circuit. The pair of conductors 11, 11 is adapted to be connected to the musical device 20 by an adapter 30 to form a part of the electric circuit. A speaker 27, which may be an output piezo, is connected to IC 25, so that when the electric circuit of musical device 20 is closed, musical IC 25 is energized to produce a series of audio signals which are converted into a sound, or musical sound, by speaker 27.

Figure 2:
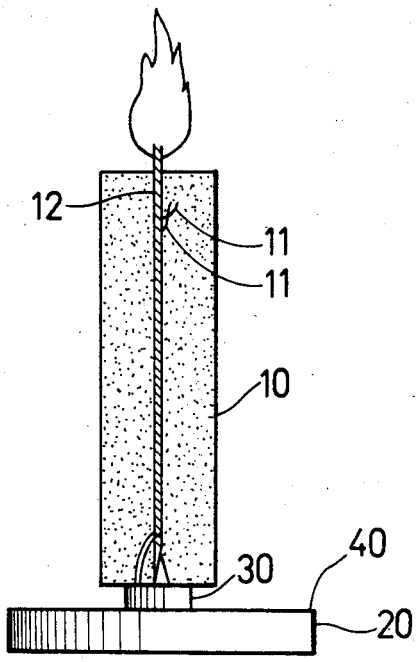
FIG. 2 is a front view of an embodiment of the musical candle of this invention, with the candle in section.

As shown in FIG. 2, candle 10 has a wick 12 and a pair of conductors 11, 11 which are wound around wick 12, conductors 11, 11 having first ends extending to the proximity of the upper end of wick 12 and second ends adapted to be connected to musical device 20 by an adapter 30; musical device 20 being provided in candle stand 40.

Figure 3:
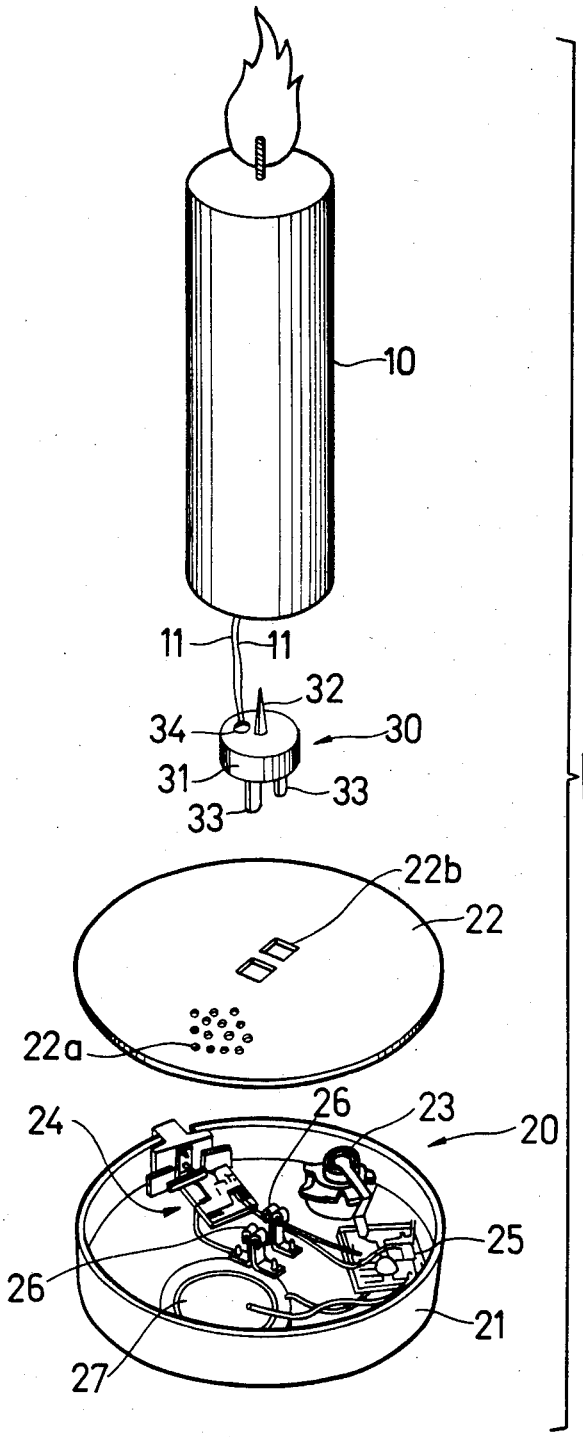
FIG. 3 is an exploded, perspectilve view of the embodiment of the musical candle of FIG. 2.

As shown in FIG. 3, candle 10 is so prepared that the second ends of conductors 11, 11 extend from the bottom of candle 10. Adapter 30 is provided with a body 31, a nail member 32 extending from the upper side of body 31, and a pair of connection terminals 33 extending from the opposite side of body 31. A through hole 34 is formed in body 31 so as to enable the lower end of conductors 11, 11 to pass through hole 34 to be tied onto terminals 33, 33.

Candle stand 40 consists of base 21, cover 22 having holes *22a* and *22b*, and a musical device 20 including a musical IC 25, a switch 24, a battery 23 and a speaker 27 connected as described above. A pair of clip-type terminals 26 is provided in the circuitry of musical device 20 to receive bar-type terminals 33 of adapter 30.

Candle 10 is prepared as a separate unit without being readily connected to musical device 20. To connect candle 10 to musical device 20, first candle 10 is mounted on adapter 30 by inserting nail member 32 of adapter 30 into the bottom of candle 10, while the lower, second ends of conductors 11, 11 are passed through hole 34 with each conductor being tied to a different terminal 33, 33 respectively. Needless to say, the insulation coating of the end parts of conductors 11, 11 must be removed before the end parts are tied to terminals 33, 33. Adapter 30 is then mounted on candle stand 40 by inserting terminals 33, 33 into clips-type terminals 26, 26 through holes *22b* of cover 22.

To use the musical candle of this invention, switch 24 is first turned on. Then candle 10 is lit. As the upper end of wick 12 of candle 10 burns, upper ends of conductors 11, 11 are burned to fuse together thus electrically connecting the two conductors 11, 11. As a result the electric circuit of musical device 20 is closed and musical IC 25 is energized to produce a series of audio signals which are fed into to speaker 27 to produce a musical sound.

In order to ensure that conductors 11, 11 are effectively burned to fuse together, conductors 11, 11 may be formed with enamel coated copper or aluminum wires of AWG No. 39 to 42, or equivalent.

Figure 4:
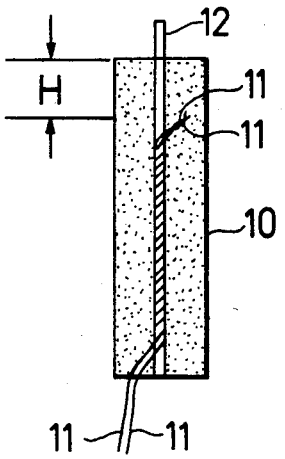
FIG. 4 is a schematic cross sectional view of the candle showing an alternative arrangement of the conductors.

To provide a joyful surprise to the person at the party, conductors 11, 11 may be cut short so that the upper ends of conductors 11, 11 are left apart a certain distance H from the top of wick 12 as shown in FIG. 4. In this arrangement the music is produced after the candle has burned along the distance H, thus giving a surprise when the music comes suddenly from an unknown source.

Furthermore, in order to assure that the conductors are fused when they are burned, twisting together conductors 11, 11 is preferable.

Figure 5:
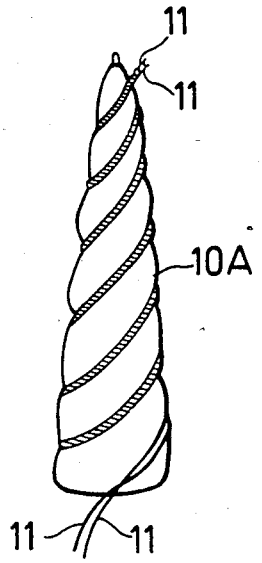
FIG. 5 is a front view of a second embodiment of the musical candle of this invention.

Conductors 11, 11 may also be disposed along a spiral groove in the case of a spiral-shaped candle 10 A as shown in FIG. 5.

I claim:

1. A musical candle, comprising:

a candle having a body and a wick, a pair of electric conductors arranged along said candle, said electric conductors being each insulated and capable of burning by a candle flame to fuse together, a musical device having a music producing unit capable of producing a musical sound when electrically activated, said musical device having a electric power source from which an electric power is supplied to said music producing unit through said electric conductors.

2. A musical candle as recited in claim 1, wherein said pair of electric conductors has a free end disposed apart from the upper end of said wick.

3. A musical candle as recited in claim 1, wherein said pair of electric conductors is wound around said wick.

4. A musical candle as recited in claim 1, wherein said body of said candle has a spiral groove and said pair of electric conductors is disposed in said spiral groove.

5. A musical candle as recited in claim 1, wherein said musical device is provided in a candle stand and said pair of electric conductors is connected to said musical device by an adapter to which said candle is mounted, said adapter being detachably mounted onto said candle stand.

* * * * *